US008616529B2

(12) United States Patent
Kim et al.

(10) Patent No.: US 8,616,529 B2
(45) Date of Patent: Dec. 31, 2013

(54) WINCH AND AUTONOMOUS MOBILE APPARATUS INCLUDING THE SAME

(75) Inventors: Sang-Whee Kim, Gyeonggi-do (KR); Seong Ho Cho, Daejeon (KR); Hyun Goo Kim, Daejeon (KR); Young Jun Park, Daejeon (KR); Ki Soo Cho, Gyeonggi-do (KR)

(73) Assignee: Samsung Heavy Ind. Co., Ltd., Seoul (KR)

( * ) Notice: Subject to any disclaimer, the term of this patent is extended or adjusted under 35 U.S.C. 154(b) by 104 days.

(21) Appl. No.: 13/263,188

(22) PCT Filed: Apr. 1, 2010

(86) PCT No.: PCT/KR2010/002015
§ 371 (c)(1),
(2), (4) Date: Nov. 9, 2011

(87) PCT Pub. No.: WO2010/117160
PCT Pub. Date: Oct. 14, 2010

(65) Prior Publication Data

US 2012/0048152 A1 Mar. 1, 2012

(30) Foreign Application Priority Data

Apr. 6, 2009 (KR) ..... 10-2009-0029628

(51) Int. Cl.
*B66D 3/00* (2006.01)

(52) U.S. Cl.
USPC ..... 254/385; 254/383; 254/335

(58) Field of Classification Search
USPC ..... 254/333, 335, 383, 385; 242/397.2, 242/397.3, 399, 419.9
See application file for complete search history.

(56) References Cited

U.S. PATENT DOCUMENTS 190,811 A * 5/1877 Bevelander ..... 242/397.2
481,641 A * 8/1892 Schneider ..... 242/397.3

(Continued)

FOREIGN PATENT DOCUMENTS

JP 1992-39297 2/1992
JP 7-42776 U 8/1995

(Continued)

OTHER PUBLICATIONS

International Search Report of PCT/KR2010/002015.

(Continued)

*Primary Examiner* — Emmanuel M Marcelo
*Assistant Examiner* — Michael Gallion
(74) *Attorney, Agent, or Firm* — Edwards Wildman Palmer LLP; Jeffrey D. Hsi; Carolina E. Save

(57) ABSTRACT

The present invention discloses a winch and an autonomous mobile apparatus including the winch. The winch can include: a driving motor; a drum driving axle configured to be rotated the driving motor; a wire drum configured to be rotated by the drum driving axle; a roller driving axle arranged to be parallel to the drum driving axle and configured to be rotated in different direction from that of the drum driving axle by the driving motor; a roller connected with the roller driving axle and configured to support a wire wound on or unwound from the wire drum; and a one way clutch installed in the roller driving axle in such a way that a driving force transferred to the roller by the roller driving axle is cut off when the wire drum rotates in a direction of winding the wire. The roller can be transferred with a driving force by the roller driving axle and can be rotated in such a way that a wire placed between the wire drum and the roller maintains tension when the wire drum rotates in a direction of unwinding the wire.

6 Claims, 5 Drawing Sheets

(56) References Cited

U.S. PATENT DOCUMENTS

| | | | | | |
|---|---|---|---|---|---|
| 498,655 | A * | 5/1893 | Ivens | 254/280 |
| 2,335,079 | A * | 11/1943 | Patterson, Jr | 254/275 |
| 2,348,987 | A * | 5/1944 | Lock | 242/157.1 |
| 2,494,003 | A * | 1/1950 | Russ | 242/397.3 |
| 2,595,655 | A * | 5/1952 | Hannay | 242/390 |
| 2,635,530 | A * | 4/1953 | Wirtz et al. | 100/10 |
| 2,641,413 | A * | 6/1953 | Bruestle | 242/470 |
| 2,660,382 | A * | 11/1953 | Wilson | 242/478.2 |
| 2,904,284 | A * | 9/1959 | Newsom | 242/397.3 |
| 3,233,397 | A * | 2/1966 | Bonikowski | 57/13 |
| 3,642,224 | A * | 2/1972 | Taylor | 242/391.2 |
| 3,687,385 | A * | 8/1972 | Skalleberg | 242/470 |
| 3,756,423 | A * | 9/1973 | Rathi | 212/278 |
| 3,901,478 | A * | 8/1975 | Peterson | 254/270 |
| 3,982,712 | A * | 9/1976 | Bassett | 242/129 |
| 4,045,001 | A * | 8/1977 | Harvey, Jr. | 254/369 |
| 4,455,961 | A * | 6/1984 | Hansen et al. | 114/254 |
| 4,541,584 | A * | 9/1985 | Rivinius | 242/486.6 |
| 4,552,339 | A * | 11/1985 | Werners et al. | 254/277 |
| 4,681,301 | A * | 7/1987 | Rinio | 254/333 |
| 4,695,010 | A * | 9/1987 | Smith | 242/478.2 |
| 4,848,697 | A * | 7/1989 | Skalleberg | 242/147 R |
| 4,899,945 | A * | 2/1990 | Jones | 242/420.6 |
| 5,009,353 | A * | 4/1991 | Alquist | 226/172 |
| 5,074,423 | A * | 12/1991 | Smith | 212/337 |
| 5,123,607 | A * | 6/1992 | Jones | 242/420.6 |
| 5,330,122 | A * | 7/1994 | Wood | 242/481.3 |
| 5,388,781 | A * | 2/1995 | Sauber | 242/388.6 |
| 5,398,911 | A * | 3/1995 | Holster | 254/267 |
| 5,415,207 | A * | 5/1995 | Burgess | 139/304 |
| 5,803,393 | A * | 9/1998 | Julian | 242/420.6 |
| 6,276,623 | B1 * | 8/2001 | Williams | 242/171 |
| 6,435,447 | B1 * | 8/2002 | Coats et al. | 242/483 |
| 6,595,495 | B1 * | 7/2003 | Hung | 254/326 |
| 6,851,641 | B1 * | 2/2005 | Fore et al. | 242/474.4 |
| 6,910,679 | B1 * | 6/2005 | Vogt et al. | 254/385 |
| 7,261,277 | B2 * | 8/2007 | Copeman | 254/323 |
| 7,380,742 | B2 * | 6/2008 | Stevens | 242/397.3 |
| 7,478,795 | B2 * | 1/2009 | Grapes et al. | 254/333 |
| 7,513,485 | B2 * | 4/2009 | Lee | 254/346 |
| 7,686,282 | B2 * | 3/2010 | Amoss et al. | 254/342 |
| 2004/0146388 | A1 * | 7/2004 | Khajepour et al. | 414/680 |
| 2004/0262443 | A1 * | 12/2004 | Hamm et al. | 242/397.2 |
| 2005/0087644 | A1 * | 4/2005 | Kim | 242/390.8 |
| 2006/0144986 | A1 * | 7/2006 | Tsai | 242/397.2 |
| 2007/0004567 | A1 * | 1/2007 | Shetty et al. | 482/69 |
| 2007/0075174 | A1 * | 4/2007 | Kohlenberg et al. | 242/397.2 |

FOREIGN PATENT DOCUMENTS

| | | | |
|---|---|---|---|
| JP | 07-259466 | A | 10/1995 |
| JP | 1990-40695 | | 2/1996 |
| JP | 1998-36084 | | 2/1998 |
| JP | 2003-128387 | A | 5/2003 |
| JP | 3580422 | B2 | 10/2004 |
| KR | 20-0259917 | | 1/2002 |
| KR | 100511672 | B1 | 8/2005 |
| KR | 10-2006-0123603 | | 12/2006 |

OTHER PUBLICATIONS

Chinese Office Action dated Apr. 24, 2013 in connection with Chinese Application No. 201080016885.4.

Japanese Office Action dated May 28, 2013 in connection with Japanese Application No. 2012-504567.

* cited by examiner

4/6

WINCH AND AUTONOMOUS MOBILE APPARATUS INCLUDING THE SAME

CROSS-REFERENCE TO RELATED APPLICATIONS

This application is the national phase under 35 U.S.C. §371 of PCT International Application No. PCT/KR2010/002015, filed Apr. 1, 2010, which claims the benefit of Korean Patent Application No. 10-2009-0029628, filed Apr. 6, 2009. The entire contents of the aforementioned applications are hereby incorporated herein by reference.

TECHNICAL FIELD

The present invention relates to a winch, more specifically to a winch that is configured to precisely control the length of a wire and an autonomous mobile apparatus having the winch.

BACKGROUND ART

In general, an autonomous mobile apparatus is used inside a block of a hull in order to carry out tasks such as welding, cutting, etc. automatically. The autonomous mobile apparatus is operated in such a way that a robot-mountable platform moves inside the block of the hull by use of a plurality of wires.

Here, a winch installed in the platform repeatedly winds and unwinds the wire that is coupled with an inner wall of the block of the hull so that the platform can move freely inside the block of the hull. Furthermore, the length of the wire that is wound and unwound by the winch needs to be precisely controlled in order to move the platform to a desired position inside the block of the hull.

However, in the commonly-used winch, if the a wire drum constituting the winch rotates in a direction of unwinding the wire while the wire does not have tension, the wire between the wire drum and a wire outlet sags or becomes loosened.

Such a loosened wire becomes either tangled of disheveled. If the winch winds the wire in this state, the wire becomes wound on the wire drum in the tangled or disheveled state. Therefore, it has been difficult to precisely control the length of the wire that is wound or unwound by the winch.

Moreover, in the commonly-used winch, if the wire drum constituting the winch rotates in a direction of unwinding the wire while the wire does not have tension, the wire that is tightly wound on the wire drum becomes loosened and separated from an external circumferential surface of the wire drum.

It is difficult to wind the wire back on the wire drum while the wire is loosened and separated on the wire drum. Therefore, it has been difficult to precisely control the length of the wire that is wound or unwound by the winch.

DISCLOSURE

Technical Problem

Contrived to solve the above problems, the present invention provides a winch and an autonomous mobile apparatus including the winch that can control the length of the wire precisely by preventing the wire from sagging and getting loosened on the wire drum when the wire drum rotates in the direction of unwinding the wire.

Technical Solution

An aspect of the present invention features a winch that can include: a driving motor; a drum driving axle configured to be rotated the driving motor; a wire drum configured to be rotated by the drum driving axle; a roller driving axle arranged to be parallel to the drum driving axle and configured to be rotated in different direction from that of the drum driving axle by the driving motor; a roller connected with the roller driving axle and configured to support a wire wound on or unwound from the wire drum; and a one way clutch installed in the roller driving axle in such a way that a driving force transferred to the roller by the roller driving axle is cut off when the wire drum rotates in a direction of winding the wire. The roller can be transferred with a driving force by the roller driving axle and can be rotated in such a way that a wire placed between the wire drum and the roller maintains tension when the wire drum rotates in a direction of unwinding the wire.

The winch can also include: a motor gear installed on one end part of the driving motor; a first drum gear installed on one end part of the drum driving axle and engaged with the motor gear; and a roller gear installed on one end part of the roller driving axle. A second drum gear engaged with the roller gear can be formed on a lateral side of the first drum gear being in contact with the drum driving axle.

The winch can also include a torque limiter installed in the roller driving axle.

The winch can also include a load cell arranged to be adjacent to the roller in order to measure tension of the wire supported by the roller.

The winch can also include a pinch roller arranged to be in contact with or adjacent to an outer circumferential end of the roller in such a way that the wire supported by the roller is prevented from escaping from the roller and having a rotation axis that is parallel to a rotation axis of the roller.

Another aspect of the present invention features an autonomous mobile apparatus movable in a predetermined work space. The autonomous mobile apparatus can include: a mobile platform movably placed inside the work space; a winch of any of claims 1 to 5 installed in the mobile platform; and a wire having one end coupled to supporting structure defining the work space and the other end coupled to the winch.

Advantageous Effects

According to an aspect of the present invention, the wire is not sagged and the wire tightly wound on the wire drum is not loosened or separated on the wire drum when the wire drum rotates in the direction of unwinding the wire by maintaining the tension in the wire placed between the roller and the wire drum even if the wire drum rotates in the direction of unwinding the wire.

Moreover, by preventing the wire from getting tangled or disheveled by the sagging or loosening of the wire, it becomes possible for the winch to precisely control the length of the wire.

According to another aspect of the present invention, the autonomous mobile apparatus including the winch that can precisely control the length of the wire that is wound or unwound can be moved precisely a desired location inside a work space.

MODE FOR INVENTION

Figure 1:
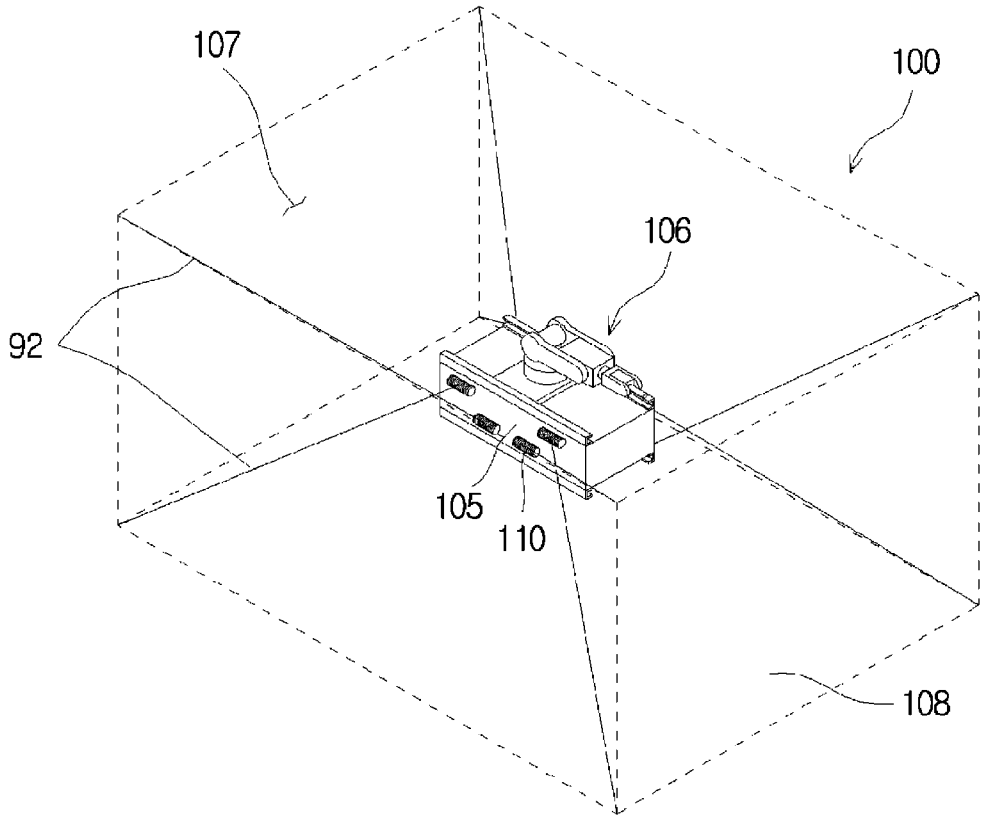
FIG. 1 is a diagram briefly showing an autonomous mobile apparatus including a winch in accordance with an embodiment of the present invention.

Hereinafter, an embodiment of the present invention will be described in detail with reference to the accompanying drawings. Any identical or corresponding elements will be assigned with identical reference numerals, and they will not be described redundantly.

FIG. 1 is a diagram briefly showing an autonomous mobile apparatus 100 including a winch in accordance with an embodiment of the present invention. The autonomous mobile apparatus 100 moves freely in a predetermined work space 107, such as an inside of a block of a hull.

Referring to FIG. 1, the autonomous mobile apparatus 100 includes a mobile platform 105, a winch 110 and a wire 92. The mobile platform 105 is placed and moves inside the work space 107.

Mounted moveably on an upper side along a lengthwise direction of the mobile platform 105 is work equipment 106, which can perform tasks such as welding, cutting and painting. Moreover, work equipment that can perform tasks such as blasting and retrieving grit can be moveably mounted on a lower side along a lengthwise direction of the mobile platform 105.

A plurality of winches 110 are installed in the mobile platform 105. The winch 110 is coupled with the other end of the wire 92, one end of which is coupled with a supporting structure 108 defining the work space 107. Here, the supporting structure defining the work space refers to, for example, a partition wall that demarks a block of a hull, and various other forms of supporting structures can be applied to the present embodiment.

The autonomous mobile apparatus 100 configured as described above is operated in such a way that the mobile platform 105 can move freely inside the work space 107 as the winch 110 is used to wind or unwind the wire 92 coupled with the winch 110.

In such a case, the winch 110 is configured to precisely control the length of the wire 92 that is wound or unwound. Accordingly, the autonomous mobile apparatus 100 is operated to move the mobile platform 105 precisely to a desired location of the work space 107.

Figure 2:
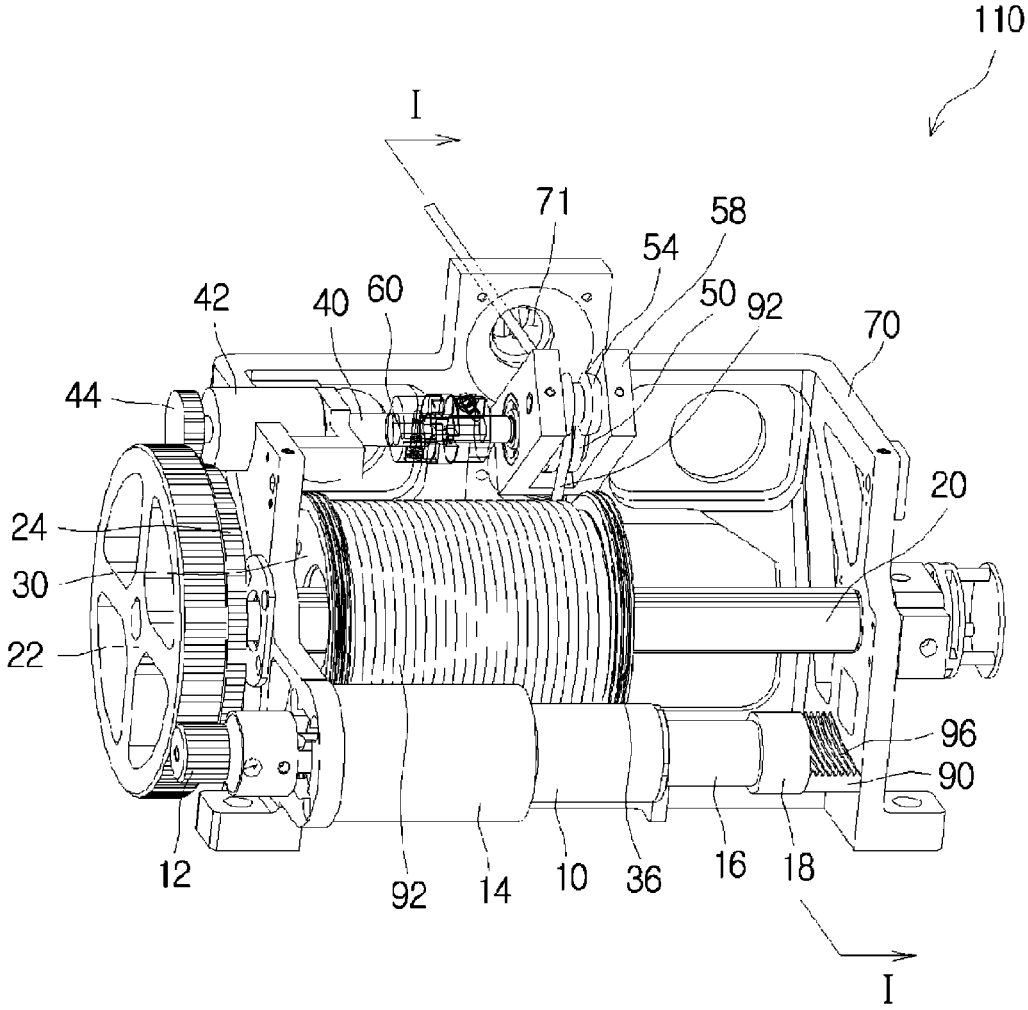
FIG. 2 is a perspective view of the winch in accordance with an embodiment of the present invention.
Figure 3:
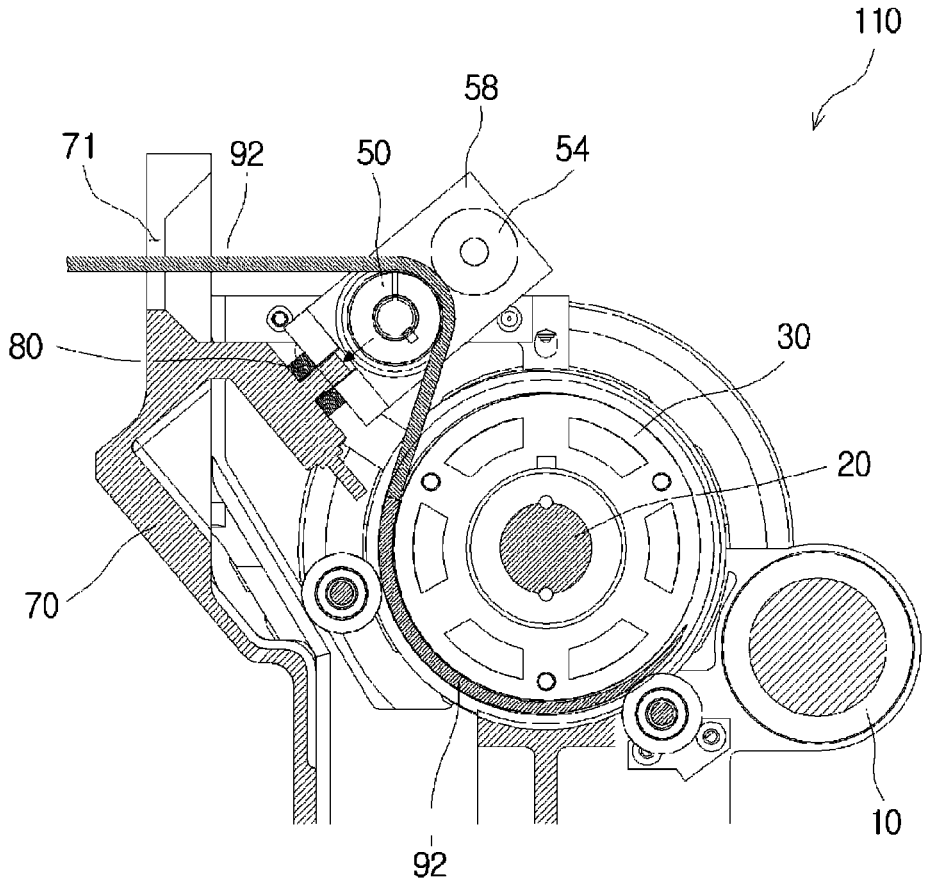
FIG. 3 is a cross-sectional view of FIG. 2 along the "I-I" line.

FIG. 2 is a perspective view of the winch in accordance with an embodiment of the present invention, and FIG. 3 is a cross-sectional view of FIG. 2 along the "I-I" line. Referring to FIG. 2, the winch 110 in accordance with an embodiment of the present invention includes a driving motor 10, a drum driving axle 20, a wire drum 30, a roller driving axle 40, a roller 50 and a one way clutch 60.

The driving motor 10 provides a driving force for rotating the drum driving axle 20. Referring to FIG. 2, the driving motor 100 is connected with a decelerator 14 and a motor brake 16. Moreover, the driving motor 10 can be connected with an encoder 18 for measuring the amount of rotation of a rotation axle of the driving motor 10. However, the decelerator, motor brake and encoder that are connected with the driving motor 10 can be selectively applied.

The driving motor 10 is installed in a supporting frame 70. The supporting frame 70, which is a supporting structure installed in the mobile platform 105, is installed in the drum driving axle 20, which is rotated by receiving the driving force from the driving motor 10.

A motor gear 12 is installed at one end part of the driving motor 10 in order to transfer the driving force of the driving motor 10 to the drum driving axle 20, and a first drum gear 22, which is engaged with the motor gear 12, is installed at one end part of the drum driving axle 20.

Referring to FIG. 2, the wire drum 30 is installed on the drum driving axle 20. The wire drum 30, which is configured to wind the wire 92, is formed in the shape of a cylinder. In the present embodiment, the wire drum 30 is installed on the drum driving axle 20 in such a way that the wire drum 30 is rotated by the drum driving axle 20 and can move along the drum driving axle 20. For this, the drum driving axle 20 and the wire drum 30 can be coupled to each other in a ball spline method.

The wire drum 30 of the present embodiment has a first screw part 36 formed on external circumferential surfaces of both lengthwise ends thereof. The first screw part 36 is engaged with a second screw part 96 formed on a guide part 90, which will be described later. However, the first screw part 36 is not necessarily formed on both ends of the wire drum 30 but can be formed on one end of the wire drum 30.

Referring to FIG. 2, the guide part 90, which is arranged to be parallel to the drum driving axle 20, is formed on one side of the drum driving axle 20. The guide part 90 can be formed in one body with the supporting frame 70 or can be separately made and arranged.

The guide part 90 has the second screw part 96, which is extended in the lengthwise direction of the drum driving axle 20 and is engaged with the first screw part 36, on a lateral side that faces the drum driving axle 20. The wire drum 30 can move along the guide part 90 while the first screw part 36 is engaged with the second screw part 96, when the wire drum 30 is rotated by the drum driving axle 20.

Accordingly, as the wire drum rotates and moves along the guide part 90, the wire 92 can be neatly wound on the wire drum 30 or unwound from the wire drum 30 in an orderly fashion.

Screw threads formed on the first screw part 36 and the second screw part 96 have a fixed pitch. In such a case, every time when the wire drum 30 makes one full rotation, the wire drum 30 moves a constant distance along the guide part 90.

Accordingly, when the wire drum 30 moves along the guide part 90, the winch 110 is operated to wind the wire 92 on the wire drum 30 or to unwind the wire 92 from the wire drum 30 at a predetermined position in a lengthwise direction of the guide part 90, for example, at a position on a plane that is perpendicular to the lengthwise direction of the guide part 90 and passes through a center of a wire outlet 21.

In the present embodiment, the roller driving axle 40 is arranged to be parallel to the drum driving axle 20. The roller driving axle 40 is configured to the roller 50 and is rotated by the driving motor 10 in a different direction from the driving axle 20.

Referring to FIG. 2, a roller gear 44, which is installed on one end of the roller driving axle 40, and a second drum gear 24 are formed on a lateral side of the first drum gear 22, which is in contact with the drum driving axle 20. Accordingly, the driving force of the driving motor 10 is transferred to the roller driving axle 40, and the roller driving axle 40 is rotated in a direction that is different from a rotating direction of the drum driving axle 20.

In the present embodiment, the roller driving axle 40 is connected with the roller 50. The roller 50 supports the wire 92 that is wound on or unwound from the wire drum 30. The roller 50 is rotatably installed on a roller supporting part 58, and an end part of the roller supporting part 58 is installed on the supporting frame 70.

As it can be seen in FIG. 2, the wire 92 can be wound on the wire drum 30 while the wire 92 is supported by the roller 50 through an outlet 71 formed in the supporting frame 70. Alternatively, the wire 92 can pass through the outlet 71 while supported by the roller when the wire 92 is unwound from the wire drum 30.

In the present embodiment, the winch 110 also includes a pinch roller 54 having a rotation axis that is parallel to a rotation axis of the roller 50. The pinch roller 54 prevents the wire 92 supported by the roller 90 from escaping from the roller 50. The pinch roller 54 is arranged by being in contact with or adjacent to an outer circumferential end of the roller 50 and is rotatably installed on the roller supporting part 58.

Referring FIG. 3, the winch 110 of the present embodiment also includes a load cell 80 that is arranged by being adjacent to the roller 50. The load cell 80, which is for measuring the tension of the wire 92 supported by the roller 50, is installed on an end part of the roller supporting part 58 on which the roller 50 is installed.

Once the wire 92 supported by the roller 50 has tension, the roller 50 provides a load toward the load cell 80, In such a case, the tension of the wire 92 can be measured through the load provided to the load cell 80.

In the present embodiment, the one way clutch 60 is installed in the roller driving axle 40. The one way clutch 60 is operated in such a way that the driving force transferred to the roller 50 by the roller driving axle 40 is cut off when the wire drum 30 rotates in the direction of winding the wire 92 and is delivered to the roller 50 by the roller driving axle 40 when the wire drum 30 rotates in the direction of unwinding the wire 92.

Accordingly, when the wire drum 30 rotates in the direction of winding the wire 92, the roller 50 is rotated by friction with the wire 92 that is wound toward the wire drum 30 while not affected by the driving force transferred by the roller driving axle 40.

Moreover, when the wire drum 30 rotates in the direction of unwinding the wire 92, the roller 50 is rotated by the driving force transferred by the roller driving axle 40. In such a case, the roller 50 is rotated in a direction of discharging the wire 92 through the outlet 71, as it can be seen in FIG. 2.

In the present embodiment, by rotating the roller 50 as described above, the wire 92 unwound from the wire drum 30 is pulled toward the outlet 71 due to the friction with the roller 50, and the wire 92 placed between the roller 50 and wire drum 30 maintains the tension.

In order for the wire 92 placed between the roller 50 and the wire drum 30 to maintain the tension while the wire 92 is unwound from the wire drum 30, the roller 50 needs to rotate to pull a longer length of the wire 92 toward the outlet 71 than the length of the wire 92 unwound by the wire drum 30 in a same duration of time. For this, a gear ratio of the roller gear 44 and the second drum gear 24 can be appropriately adjusted.

Furthermore, according to an embodiment of the present invention, a torque limiter 42 is installed in the roller driving axle 40. The torque limiter 42 prevents an excessive driving force from being transferred to the roller 50 by the roller driving axle 40.

Here, the excessive driving force refers to an a driving force that is at least the same as the driving force at a moment when slip occurs between the roller 50 rotating in the direction of discharging the wire 92 and the wire 92 supported by the roller 50 when the wire drum 30 rotates in the direction of unwinding the wire 92.

As such, by installing the torque limiter 42 on the roller driving axle 40, the slip occurring between the roller 50 and the wire 92 supported by the roller 50 can be prevented, and the wire 92 can be prevented from being damaged by the slip.

Figure 4:
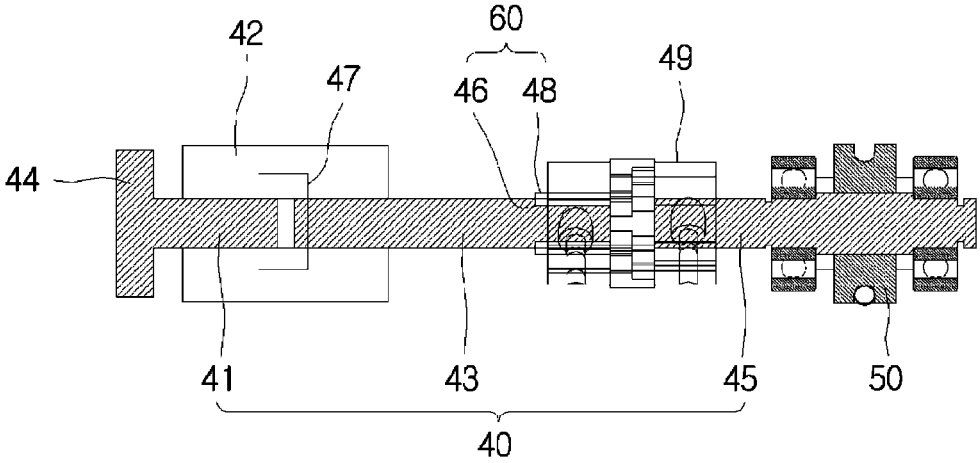
FIG. 4 is a diagram briefly showing a lengthwise section of a roller driving axle included in the winch in accordance with an embodiment of the present invention.

FIG. 4 briefly shows a lengthwise cross section of the roller driving axle 40 included in the winch 110 in accordance with an embodiment of the present invention. Referring to FIG. 4, the roller driving axle 40 is divided into three parts.

Specifically, the roller driving axle 40 includes a first axle 41 having an end coupled to the roller gear 44, a second axle 43 connected with the first axle 41 by the torque limiter 42, and a third axle 45 connected with the second axle 43 by the one way clutch 60.

Here, the torque limiter 42 is configured to have a connector 47, which transfers a rotating force, to slip or separate in case a load exceeding a regulation is applied. In addition, the torque limiter 42 has an inner wheel 46 coupled with the second axle 43 and an outer wheel 48 coupled with the third axle 45.

In such a case, the outer wheel 48 of the one way clutch 60 can be connected with the third axle 45 by a coupling 49, which is for preventing angular deviation and eccentricity between the second axle 43 and the third axle 45. Alternatively, the outer wheel 48 of the one way clutch 60 can be directly coupled with the third axle 45.

Figure 5:
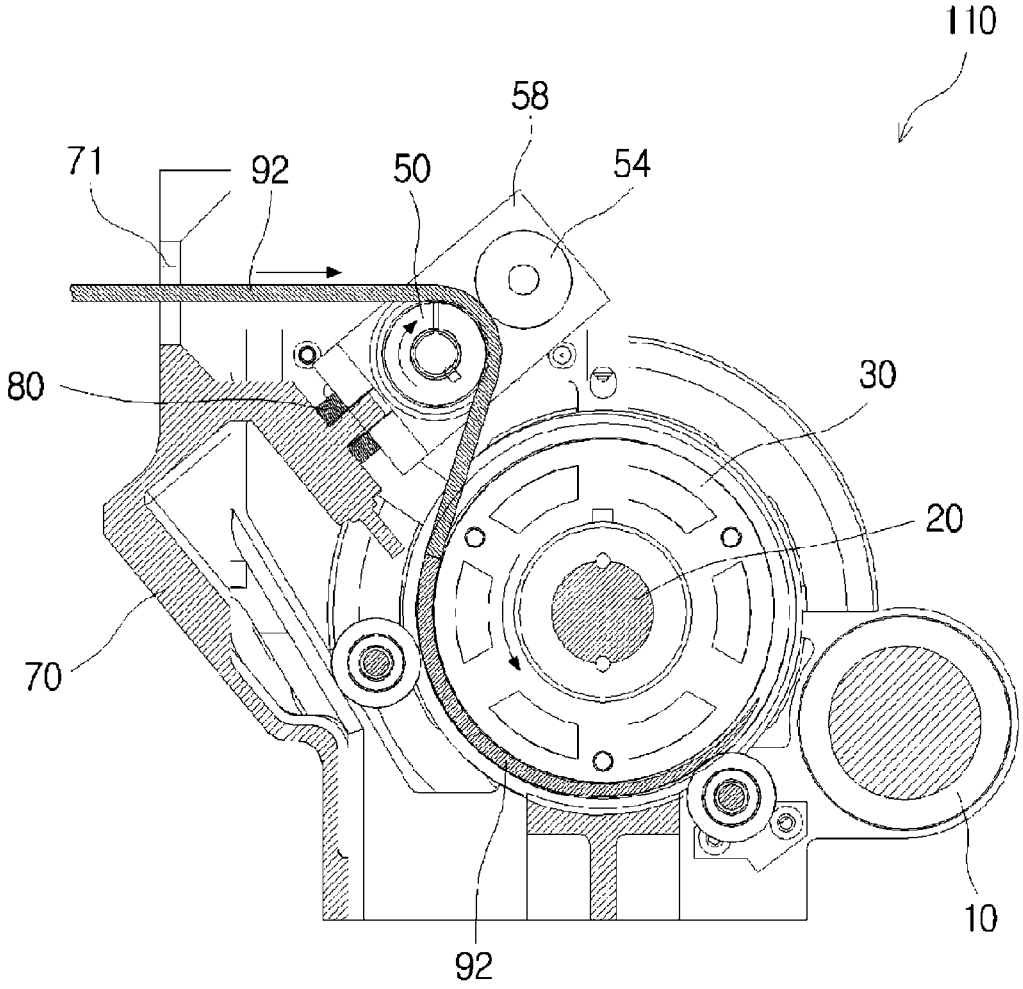
FIGS. 5 and 6 show operational states of the winch in accordance with an embodiment of the present invention.
Figure 6:
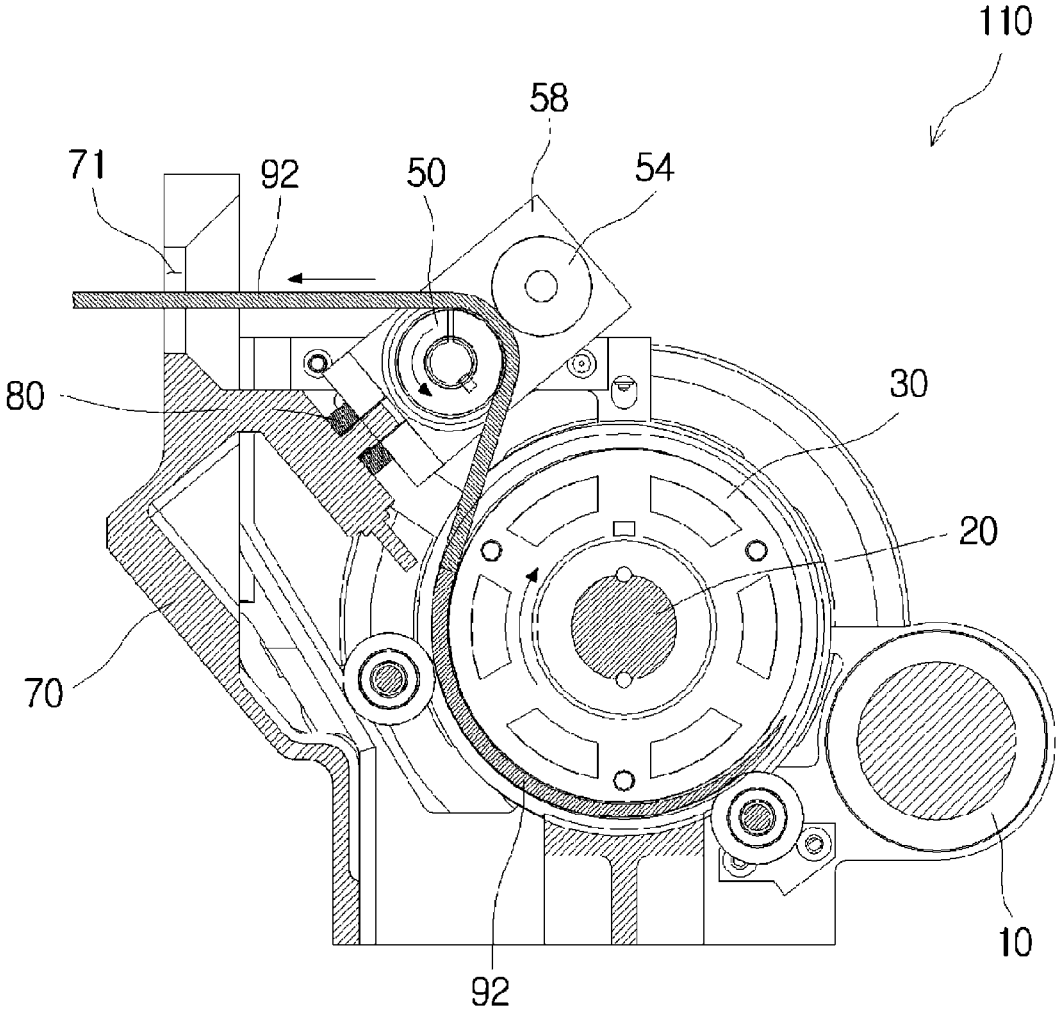

FIGS. 5 and 6 show operational states of the winch 110 in accordance with an embodiment of the present invention. Referring to FIG. 5, the winch 110 is operated to wind the wire 92.

In such a case, the wire drum 30 rotates in the direction of winding the wire 92. Then, the driving force transferred to the roller 50 from the roller driving axle 40 is cut off by the one way clutch 60. Accordingly, the roller 50 is rotated in the direction of winding the wire 92 toward the wire drum 30 by due to the friction with the wire 92.

Referring to FIG. 6, the winch 110 is operated to unwind the wire 92. In such a case, the wire drum 30 rotates in the direction of unwinding the wire 92. Then, the roller 50 is transferred with the driving force by the roller driving axle 40 and is rotated in the direction of discharging the wire to the outside through the outlet 71.

In such a case, the roller 50 is rotated in such a way that the wire 92 placed between the roller 50 and the wire drum 30 has tension. And the torque limiter 42 is operated to prevent an excessive driving force from being transferred to the roller 50 by the roller driving axle 40. Accordingly, the slip that can occur between the roller 50 and the wire 92 supported by the roller 50 is prevented.

As described above, with the winch in accordance with an embodiment of the present invention, sagging or loosening of the wire that occurs in the conventional winch does not occur, by maintaining the tension in the wire placed between the roller and the wire drum even if the wire drum rotates in the direction of unwinding the wire.

Moreover, the winch can prevent the wire from getting tangled or disheveled by the sagging or loosening of the wire. Therefore, it becomes possible for the winch in accordance with an embodiment of the present invention to precisely control the length of the wire.

Furthermore, the autonomous mobile apparatus including the winch that can precisely control the length of the wire that is wound or unwound can be moved precisely to a desired location inside a work space.

Although an embodiment of the present invention has been described, the technical ideas of the present invention are not restricted to the embodiment presented herein, and another embodiment shall be possible by a person of ordinary skill in the art to which the present invention pertains by supplementing, modifying, deleting and adding elements of the present invention within the same scope of the technical ideas, but this shall be also included in the scope of the technical ideas of the present invention.

The invention claimed is:

1. A winch comprising:

a driving motor;

a drum driving axle configured to be rotated by the driving motor;

a wire drum configured to be rotated by the drum driving axle;

a roller driving axle arranged to be parallel to the drum driving axle and configured to be rotated in different direction from that of the drum driving axle by the driving motor;

a roller connected with the roller driving axle and configured to support a wire wound on or unwound from the wire drum; and a one way clutch installed in the roller driving axle in such a way that a driving force transferred to the roller by the roller driving axle is cut off when the wire drum rotates in a direction of winding the wire, wherein the roller is transferred with a driving force by the roller driving axle and is rotated in such a way that a wire placed between the wire drum and the roller maintains tension when the wire drum rotates in a direction of unwinding the wire.

2. The winch of claim 1, comprising:

a motor gear installed on one end part of the driving motor;

a first drum gear installed on one end part of the drum driving axle and engaged with the motor gear; and a roller gear installed on one end part of the roller driving axle, wherein a second drum gear engaged with the roller gear is formed on a lateral side of the first drum gear being in contact with the drum driving axle.

3. The winch of claim 1, further comprising a torque limiter installed on the roller driving axle.

4. The winch of claim 1, further comprising a load cell arranged to be adjacent to the roller in order to measure tension of the wire supported by the roller.

5. The winch of claim 1, further comprising a pinch roller arranged to be in contact with or adjacent to an outer circumferential end of the roller in such a way that the wire supported by the roller is prevented from escaping from the roller and having a rotation axis that is parallel to a rotation axis of the roller.

6. An autonomous mobile apparatus movable in a predetermined work space, the autonomous mobile apparatus comprising:

a mobile platform movably placed inside the work space;

a winch of any of claims 1 to 5 installed in the mobile platform; and a wire having one end coupled to a supporting structure defining the work space and the other end coupled to the winch.

* * * * *